United States Patent [19]

White et al.

[11] 4,045,308

[45] Aug. 30, 1977

[54] BATH LEVEL SET POINT CONTROL IN AN ELECTROLYTIC CELL AND METHOD OF OPERATING SAME

[75] Inventors: Russell L. White, Vienna, W. Va.; Kenneth L. Edwards, Louisville, Tenn.

[73] Assignee: Aluminum Company of America, Pittsburgh, Pa.

[21] Appl. No.: 738,657

[22] Filed: Nov. 4, 1976

[51] Int. Cl.[2] ..... C25C 3/06

[52] U.S. Cl. ..... 204/67; 204/243 R

[58] Field of Search ..... 204/67, 243, 244

[56] References Cited

U.S. PATENT DOCUMENTS

| | | | |
|---|---|---|---|
| 3,622,475 | 11/1971 | Shiver | 204/67 |
| 3,629,079 | 12/1971 | Bristol | 204/67 |
| 3,632,488 | 1/1972 | Decker et al. | 204/67 |

*Primary Examiner*—John H. Mack
*Assistant Examiner*—H. A. Feeley
*Attorney, Agent, or Firm*—Elroy Strickland

[57] ABSTRACT

A method and apparatus for controlling the rate at which material is fed to a molten salt bath in a process utilizing the material to produce molten metal. The apparatus includes means for generating a signal that represents the actual level of the salt bath, means for generating a signal representing the density of the salt bath, and means for generating a signal representing the volume of the metal beneath the salt bath. A circuit is provided for receiving and storing an initial datum representing a desired concentration of the material in the molten bath, and for receiving the above signals, the circuit being further capable of calculating a bath level in response to said signals that will maintain the initial percent concentration of the material during the time molten metal is being produced and when molten metal is removed from the bath.

6 Claims, 1 Drawing Figure

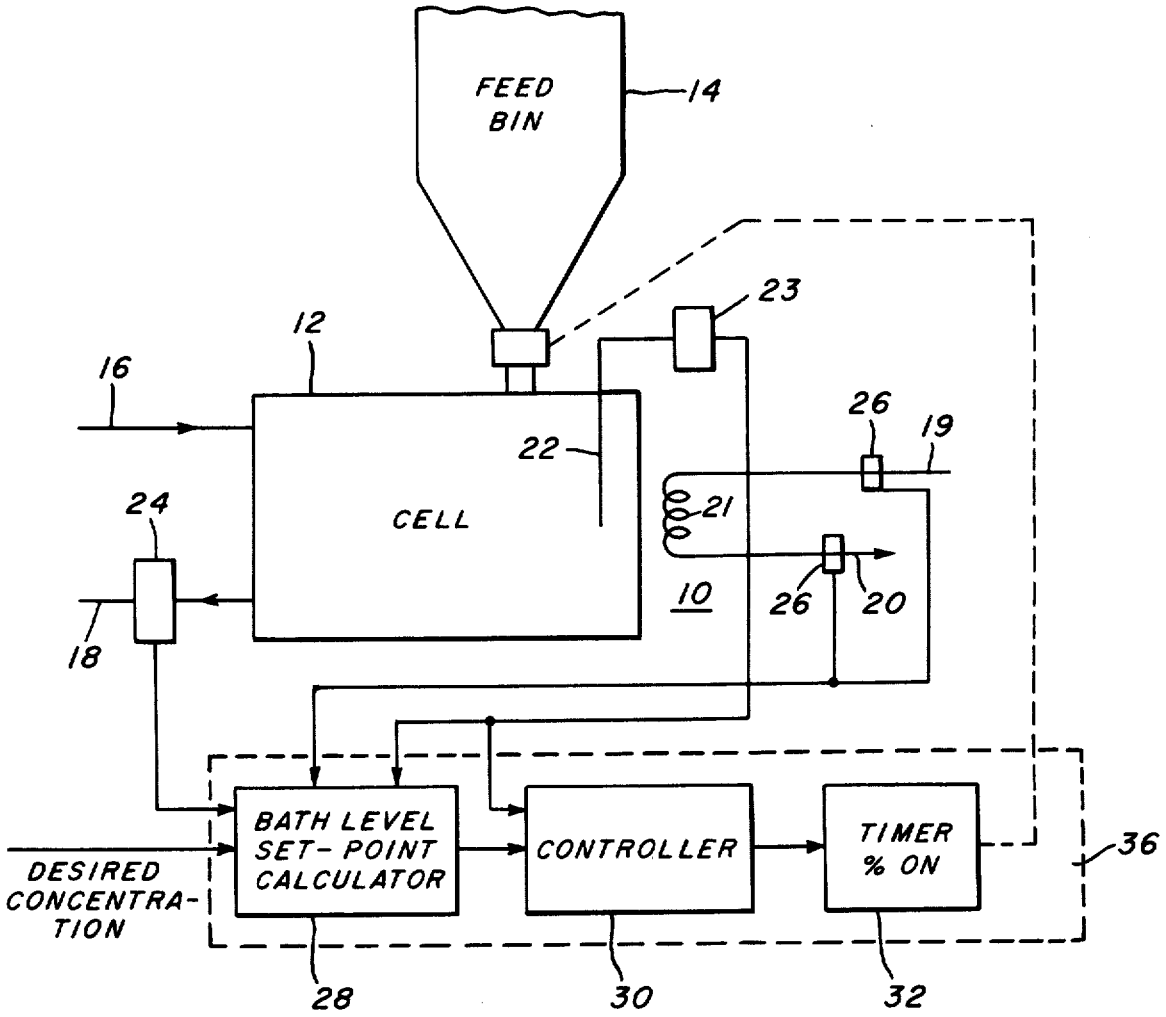
FEED BIN
14
23
12
16
26
19
22
24
CELL
21
10
26
20
18
BATH LEVEL SET- POINT CALCULATOR
CONTROLLER
TIMER % ON
36
DESIRED CONCENTRA- TION
28
30
32

BATH LEVEL SET POINT CONTROL IN AN ELECTROLYTIC CELL AND METHOD OF OPERATING SAME

BACKGROUND OF THE INVENTION

The present invention relates generally to the control of metal producing, electrolytic cells, and particularly to a circuit arrangement providing control of the bath level within the cell without using measurements of the electrical resistance of the bath.

If molten aluminum is reduced electrolytically from a feed material such as aluminum chloride, for example, in a salt bath contained within a cell, the efficiency of the aluminum producing process within the cell depends upon maintaining a concentration of the aluminum chloride in the salt bath within appropriate, predetermined, percentage limits. This is accomplished by controlling the rate at which aluminum chloride is fed to the cell from a bin or hopper as aluminum metal and chloride gas is produced within the cell. In the present invention such control is effected and ceell efficiency maximized by measuring certain process variables, presently to be explained, and calculating a bath level based upon these variables that will automatically maintain the proper percent concentration of aluminum chloride (or other feed material) in the bath as reduction takes place, i.e., as aluminum and chloride gas, for example, is produced and when the metal is removed from the cell.

Heretofore, however, control of the feeding of alumina or an aluminum halide to the salt bath of electrolytic cells employed in the production of aluminum has usually been effected by making contemporary measurements of the electrical resistance of the bath, as determined by the voltage existing across and the current flowing through the cell. Examples of such control procedures and apparatus are shown and described in such U.S. Pat. Nos. as Dirth et al 3,573,179; Shiver 3,622,475; Goodnow et al 3,812,024 and Haupin 3,847,761. Though the use of cell resistance as the controlling mechanism for the ordering of feed material to the cell has been a successful improvement over prior means and methods, the electrical resistance of a cell is affected by certain cell variables and conditions that make a different control mechanism desirable.

For example, a change in the temperature of the salt bath will change the electrical resistance of the bath. In addition, a layer of gas bubbles on an electrode of the cell can affect the resistance of a cell. Further, the shorting of a compartment of a cell changes the overall resistance of the cell. It can be appreciated that such conditions have nothing to do with the amount of feed material required for proper and efficient cell operation. Hence, the use of resistance measurements as a means to control the feed of material to the cell is not always reliable.

Further, as explained in the above Haupin patent, the standard curve for cell resistance versus concentration of an aluminum halide such as aluminum chloride ($AlCl_3$) has a knee or inflection that can be misleading in regard to the need of further additions of $AlCl_3$to the cell, i.e. if the resistance reading is on the "wrong" side of knee, additional amounts of $AlCl_3$ might be ordered when actually the cell is already oversupplied with $AlCl_3$.

BRIEF SUMMARY OF THE INVENTION

The present invention involves the control of feed material to a salt bath in a metal producing process and cell based upon contemporary bath level measurements rather than on contemporary resistance measurements of the bath. This is accomplished by a method and apparatus in which the height and density of the molten salt is measured and the volume or height of molten metal produced by the process is measured. Signals representing these measurements are directed to a bath level set point (BLSP) calculator which calculates a salt bath level that will maintain the proper concentration of the material within the bath as metal is produced and removed from the cell. Since the only items that affects bath level within a cell are the layer of molten metal produced in the bottom of the cell and the molten salt above the layer of metal, the process and apparatus of the present invention provide a highly efficient and reliable mechanism for controlling the feed of the material to a bath.

THE DRAWING

The advantages and objectives of the invention will be best understood from consideration of the following detailed description when read in connection with the accompanying drawing, the sole FIGURE of which is a schematic representation of an electrolytic cell and circuit arrangement for controlling the feed of material to the cell.

Preferred Embodiment of the Invention

Referring now to the figure of the drawing, numeral 10 designates a novel circuit arrangement for controlling the feed of material, such as an aluminum halide, to an electrolytic cell 12 designed to produce molten metal, such as aluminum, by electrolytic reduction of the material feed to a molten salt bath (not shown) within the cell. Cell 12, for example, may be a multiple compartment type of cell such as shown in U.S. Pat. No. 3,822,195, though the invention is not limited thereto.

The feed material may be held in a bin or hopper 14 located over cell 12, as shown in the drawing. Electrical current for the electrolytic process within the cell is provided via buses 16 and 18, and cooling of the cell is effected by directing a cooling fluid or coolant, via conduits 19 and 20, to and from water jackets located externally of the cell but in close proximity to the shell and lid of the cell, which are only representatively shown in the drawing. The water jackets are represented in the drawing by a heat exchanger 21.

The circuit arrangement 10 includes tube means 22 and transducer 23 adapted to measure the height or level of the salt bath within cell 12, a device 24 located on or adjacent bus 18 and sensitive to the flow of direct current in the bus. Two heat sensors 26 respectively located in heat tranfer relationship with conduit 19 and 20 are shown to indicate the increment ($\Delta T$) of heat exchange between 21 and cell 12.

The tube means 22 may comprise a simple hollow tube that extends vertically into the bath from the top of the cell, with transducer 23 connected in fluid communication with the upper end of the tube, the transducer being sensitive to changes in pressure within the tube that occur when the level of the bath rises or falls within the cell. The transducer produces an electrical signal representive of the pressure within tube 22 and thus the height of the salt bath within cell 12. Preferably, a suitable fluid or gas, such as nitrogen, is directed through tube 22 to purge the tube of bath constituents that might otherwise clog the tube.

Current sensor 24 is a commercially available, direct current metering device capable of indicating the electrical load of cell 12.

As shown in the drawing, circuit 10 includes further a storage and arithmetic calculating device 28, a controller circuit 30 and a timing device 32 connected to a valve or gate means 34 located to control the exit of material from bin 14 to cell 12. The calculating device, controller and timing device may comprise a single, commercially available, digital computor 36, though individual circuit units may be employed and interconnected to perform their respective functions in a manner presently to be explained.

As schematically represented in the drawing, current metering device 24 and heat sensors 26 are electrically connected to calculating device 28, while transducer 23 is electrically connected to both the calculating device and the controller circuit 30.

The operation of the circuit 10 is as follows:

An initial datum representing the concentration of the feed material in the salt bath necessary for efficient operation of cell 12, which may be referred to as a concentration set point or CSP, is entered into and stored in a memory portion of calculator 28. The actual, contemporary level or height of the salt bath within the operating cell 12 is continuously measured by 22 and 23, with 23 continuously directing a signal voltage representative of this height to calculator 28 and to controller 30.

During the operation of cell 12, molten metal is formed and collected in the bottom of the cell beneath the salt bath. (If the feed material for the process is aluminum chloride, for example, chloride gas is produced which can be directed to appropriate collection means for reuse in making aluminum chloride.) The volume of the molten metal in the bottom of the cell, as it is produced, is determined by measuring cell load via metering device 24, and by measuring the loss of heat from the cell. This latter measurement is made by heat sensors 26 which monitor the temperature of the coolant in conduit 19 i.e., before the coolant enters water jackets 21, and by monitoring the temperature of the coolant (in conduit 20) after the coolant has left 21. The rise in temperature of the coolant, as measured by sensors 26 (and combined with a known rate of coolant flow through 21), is a measure of the BTU losses from the cell. This information, combined with the total power input to the cell (as determined by 24) will provide the percentage of cell current employed to produce metal, and is thus the current efficiency of the cell. Signals from 24 and 26 are directed to calculator 28, where they are combined to provide an indication of the amount of metal production and thus the rise of the level of metal within the cell. The calculator uses the following equation for this calculation:

$$\text{Pounds of Metal} = 0.7394 \times \text{kilo amps} \times \text{number of cell compartments} \times \text{current efficiency} \times \text{number of hours of cell operation.}$$

The weight (pounds) of the metal is directly translatable into the volume of the metal. The decimal number 0.7394 is derived from Coulomb's law, and is the amount (pounds) of aluminum made from an aluminum compound, such as an aluminum halide, by 1000 amperes of current flowing for one hour through one compartment of a multi-compartment cell at 100% current efficiency.

As metal builds in the bottom of cell 12, and corresponding signal changes are directed to calculator 28 from sensors 23 and 24, the calculator determines (calculates) a level or height for the salt bath that will maintain the concentration of feed material in the bath at the datum of concentration initially entered into the calculator, i.e., the calculator calculates a bath level set point (BLSP) voltage for controller 30, the controller 30 comparing the set point (BLSP) voltage with the bath level voltage it receives from sensor 23. The controller produces an output signal and incrementally changes its output in response to any difference that occurs between the actual bath level (as measured by 23) and the desired bath level (BLSP). The output of controller 30 is directed to timing device 32, which, in turn, orders feed material from bin 14 to cell 12 by opening valve or gate means 34 for a period of time sufficient to provide additions of material to the cell that will restore the correct percentage concentration of the material in the salt bath of the cell. As the feed material is added and the level of the salt bath rises, the signal received from 23 approaches that of the set point voltage received from 28. The controller, as it receives signals representing the desired and actual bath levels, incrementally adjusts the setting of the timer, using a proportional and integral algorithm, until the actual and desired bath levels are not only momentarily the same, but are the same on two consecutive samplings of the bath level. This latter setting of the timer is maintained until a difference occurs in the input signals to the controller from 23 and 28, at which time the controller again increments the setting of the timer until equilibrium is achieved.

Since additions of feed material are required as metal is made in an electrolytic process (the feed material being the basic raw material of the process), circuit 10 of the invention provides a feed control that is more accurate and consistent than the prior resistance measuring schemes, the amount of feed material added in the present invention being directly proportional to the production of and the increase in the level of metal in the cell.

A change in the production of chlorine gas, in the bath of a cell adapted to produce aluminum from aluminum chloride, changes the volume of chlorine bubbles and thus changes the density of the molten salts, thereby changing the volume and height of the bath. By monitoring the rate of chlorine production in the cell and providing representative data to the calculator 28, the calculator calculates a change in the set point for bath level for any change occurring in rate of $Cl_2$ production. Chlorine production is empirically related to current so that a change in cell current is read as a change in $Cl_2$ production. In circuit 10 of the invention, current metering device 24 signals such changes for the calculator such that the calculator is able to make an appropriate calculation and thereby provide an appropriate change in the bath level set point (BLSP) that is (again) directed to controller 30. The controller orders a change in the rate at which the feed material in 14 is fed to the cell in the manner explained above in connection with changes occurring in the level of the molten metal in the cell.

When metal is removed or tapped from cell 12, the level of the salt bath is lowered by a corresponding amount. This is (again) sensed by 22 and 23 which directs an appropriate signal to calculate 28, the calculator, in turn, calculating a lower set point for the salt bath. This new set point is directed to controller 30 (again), the controller ordering an amount of feed material from 14 necessary to compensate for the volume of the metal removed. In this manner the proper concentration of feed material is maintained in the salt bath for efficient operation of the cell.

If it becomes desirable and/or necessary to operate cell 12 at a present concentration level of feed material different from the one initially chosen, i.e., the old concentration set point (CSP), a new concentration level and CSP is entered into calculator 28, the calculator proceeding immediately to calculate a bath level set point (BLSP) for controller 30 that will provide the new percent concentration for the bath. This calculation is made by 28 using the following formula:

$$\text{New BLSP} = \text{Old BLSP} + (\text{new CSP} - \text{old CSP}) \times K$$

where $K$ is a function of bath density and the size of the cell above the cell anode (not shown), the anode being in the bath and above the layer of molten metal.

Whereas particular embodiments of the invention have been described above for purposes of illustration, it will be evident to those skilled in the art that numerous variations of the details may be made without departing from the invention as defined in the appended claims.

What is claimed is:

1. A method of operating an electrolytic cell for the production of aluminum by reduction of an aluminum halide in a molten salt bath, the method comprising the steps of measuring the height of the molten salt in the cell, measuring the density of the molten salt, measuring the volume of the molten metal in the cell, and adding an amount of aluminum halide to the cell sufficient to prevent deleterious reduction of molten metal salts in the bath, said amount being determined by said measurements of salt level height, salt density and metal volume in the cell.

2. The method of claim 1 in which the volume of the molten metal is determined by measuring current flow through the cell and heat losses from the cell.

3. The method of claim 1 in which the density of the molten salt is measured by measuring the rate of chlorine production within the cell.

4. An electrical device for controlling the rate at which material is fed to a molten bath utilizing the material, said device comprising, a circuit for receiving a signal voltage representing a predetermined operational level of the molten bath, a circuit for receiving a signal voltage representing the actual operating level of the molten bath, and a circuit for combining the predetermined and actual bath level signal voltages, the combining of said signals being effective to produce an output signal for ordering the feeding of the material to the molten bath for a period of time sufficient to maintain the actual bath level at that of the predetermined bath level.

5. A circuit arrangement for controlling the concentration of a material in a molten salt bath in a process for providing molten metal by reduction of the material in the salt bath, the arrangement comprising means adapted to sense the height of the salt bath and to develop a signal representative thereof, means adapted to sense the density of the salt bath and to develop a signal representative thereof, means adapted to sense the volume of the molten metal and to develop a signal representative thereof, and a circuit means for receiving said signals and for receiving and storing an initial datum representing a predetermined, desired percent concentration of the material in the bath, said circuit means being further capable of calculating a bath level in response to said signals that will maintain the initial percent concentration of the material in the bath during the time molten metal is being produced and when the molten metal is removed from the bath.

6. A circuit arrangement for controlling the concentration of aluminum chloride in a molten salt bath of an electrolytic cell adapted to produce aluminum by reduction of the aluminum chloride, the arrangement comprising means adapted to sense the height of the molten salt bath in the cell and to develop a signal representative thereof, means adapted to sense the density of the molten salt in the cell and to develop a signal representative thereof, means adapted to sense the volume of the molten aluminum in the cell and to develop a signal representative thereof, and a circuit means for receiving said signals and for receiving and storing an initial datum representing a predetermined, desired percent concentration of the aluminum chloride in the salt bath, said circuit being further capable of calculating a salt bath level in response to said signals that will maintain the predetermined, desired concentration of aluminum chloride during the time the cell is producing aluminum and chlorine and when aluminum is removed from the cell.

* * * * *